US005179746A

United States Patent [19]

Rogers

[11] Patent Number: 5,179,746

[45] Date of Patent: Jan. 19, 1993

[54] STRETCHER

[76] Inventor: D. Randall Rogers, 4019 Henning Dr., Mobile, Ala. 36619

[21] Appl. No.: 763,568

[22] Filed: Sep. 23, 1991

[51] Int. Cl.[5] ..... A61G 1/02

[52] U.S. Cl. ..... 5/625; 5/626; 5/628

[58] Field of Search ..... 5/621, 624–629, 5/648, 651, 637; 280/8, 9, 47.17, 47.18, 47.21, 47.34, 47.25, 47.315; 296/20; 128/870; 441/129

[56] References Cited

U.S. PATENT DOCUMENTS

| | | | |
|---|---|---|---|
| 1,139,636 | 5/1915 | Calhoun | 280/8 X |
| 1,704,979 | 3/1929 | Kusterle et al. | 5/658 |
| 2,201,890 | 5/1940 | Dunn | 5/627 |
| 3,137,511 | 6/1964 | Weil et al. | 280/8 X |
| 3,449,776 | 6/1969 | Brock | 5/627 |
| 3,737,923 | 6/1973 | Prolo | 128/870 X |
| 4,060,079 | 11/1977 | Reinhold, Jr. | 5/627 X |
| 4,155,206 | 4/1907 | Moody | 5/628 X |
| 4,291,891 | 9/1981 | Blanchette | 280/9 |
| 4,347,635 | 9/1982 | Eisenhauer | 5/626 X |
| 4,369,982 | 1/1903 | Hein et al. | 5/625 X |
| 4,466,145 | 8/1984 | Jones et al. | 5/625 |
| 4,566,445 | 1/1986 | Jelsma et al. | 5/625 X |
| 4,618,157 | 10/1986 | Resnick | 280/47.24 X |
| 4,794,656 | 1/1989 | Henley, Jr. | 5/652 X |
| 5,094,418 | 3/1992 | McBarnes, Jr. et al. | 5/650 |

FOREIGN PATENT DOCUMENTS

| | | | |
|---|---|---|---|
| 8455 | of 1907 | United Kingdom | 5/82 |
| 2182570 | 5/1987 | United Kingdom | 5/82 |

*Primary Examiner*—Michael F. Trettel

*Attorney, Agent, or Firm*—Jennings, Carter, Thompson & Veal

[57] ABSTRACT

A stretcher operated by one or more persons for transporting an injured patient and including a body board for supporting a patient's upper legs and body, a slide member received within the body board and extendible selected distances therefrom, and a base portion connected to the slide member opposite the body board for supporting a patient's feet and ankles. The body board has a pair of protective skids which slide on a subjacent supporting surface with the skids supporting the body board and base portion a selected distance above the supporting surface. Wheels rotably connected to the base portion support the stretcher when the stretcher is tilted relative to the supporting surface such that an individual may transport a patient on the stretcher. The wheels are supported above the skids and thus do not interfere with the sliding movement thereof. A pivotal foot rest is connected to the base portion and supports the patient when the stretcher is tilted about a transverse axis. Straps are provided to secure the patient to the stretcher and support the patient when the stretcher is tilted. An elongated handle assembly is pivotally connected to a selected end of the stretcher for controlling the sliding motion thereof down a steep incline. Flotation apparatus, detachably and reattachably connected to the body board, provide means for supporting the body board and a patient when the body board is placed in water. Apparatus for securing an oxygen tank to the stretcher is also provided and incudes a transparent cover for isolating portions of the oxygen tank from the patient's body.

31 Claims, 9 Drawing Sheets

STRETCHER

FIELD OF THE INVENTION

The present invention relates to emergency or rescue stretchers and other apparatus for manually transporting an injured patient. In greater particularity, the present invention relates to emergency stretchers that can be operated by one person to manually transport another. In even greater particularity, the present invention relates to improvements in such single operator stretchers that accommodate patients of various anatomical dimensions. Even more particularly, the present invention relates to improvements in such stretchers that permit the single operator to negotiate steep inclines such as stairs with minimum discomfort to the transported patient.

BACKGROUND OF THE INVENTION

Stretchers for carrying an injured person from the point of injury to some designated area where the patient's injuries may be better treated have been utilized throughout history. Over such an expansive time period of use the design of such stretchers has remained relatively unchanged. Most stretchers consist of a substantially planar surface having fixed handles on either end thereof such that transporting personnel may grip the handles and lift and carry a patient resting on the planar surface. Modifications to this basic structure have included foldable stretchers, stretchers having wheels for rolling the patient along a horizontal surface and stretchers having two laterally disposed wheels such than an individual can transport an injured person, unassisted, over various grades and terrain. These individually operated, wheeled stretchers are exemplified in U.S. Pat. Nos. 1,231,989 issued to Blatt; U.S. Pat. No. 3,462,186 issued to Kessling; and U.S. Pat. No. 4,369,982 issued to Hein, et al. The common feature in these stretchers is that the laterally disposed wheels extend below the substantially planar bottom surface of the stretcher portion. This design works well when transporting patients over substantially smooth and horizontal surfaces or surfaces having relatively shallow inclines. If, however, the patient must be transported over rough terrain or steep grades, the above-mentioned design present serious problems for both the patient transported and the person responsible for moving the patient. The wheels, by extending beneath the bottom surface of the stretcher, present a relatively small contact surface which tends to catch on any protrusions encountered in the rough terrain. Thus, the terrain tends to jar the wheels, stretchers and patient supported thereon as the stretcher is wheeled across such terrain.

A commonly encountered example of moving a patient over rough terrain is the manipulation of a stretcher and patient supported thereon down a flight of stairs. When a stretcher having wheels is rolled over the first step, the wheels and consequently the stretcher will fall to the second step or until the stretcher contacts the edge of the first step. This roll-and-bump action is repeated at the expense of the patient's comfort until the stretcher reaches the bottom of the flight. Preferably, a flight of stairs should be negotiated by sliding the stretcher on its bottom surface across the forward edges of the steps to minimize the discomfort of the patient thereon; however, stretchers such as those taught in Blatt, Kessling and Hein et al cannot slide down a flight of stairs without the wheels encountering each step and repetitively jolting the injured patient.

As shown in Hein et al and Kessling, apparatus is provided to support the patient when the stretcher is tilted upright during rolling transportation of the patient. Hein et al provides a platform on which the patient stands while Kessling provides a platform and a support on which a patients body case is suspended. To accommodate patients of various heights, Hein et al provides an overly elongated board having a series of holes in which portions of the platform are selectively received to position the platform at selected locations on the board. This arrangement is necessary to support patients of different height in similar relation to the securing straps provided. Though the vertical support arrangement disclosed in Hein et al accomplishes this task, the use of an overly elongated board is not commensurate with the emergency transportation of an injured patient. Commonly, patients must be retrieved from confining spaces and transported in vehicles also having limited space, thus the dimensions of the stretcher on which the patient is carried should preferably be minimized.

SUMMARY OF THE INVENTION

It is the principal object of the present invention to provide a stretcher, having wheels thereon, that may be operated by a single person to transport an injured patient up or down a flight of stairs or other steeply inclined, rough terrain with minimal discomfort to the transported patient.

In support of the principal object another object of the present invention is to provide a stretcher having the aforesaid characteristics of the principal object that will accommodate patients of various anatomical dimensions while minimizing the dimensions of the stretcher.

Yet another object of the present invention is to provide a stretcher on which an oxygen bottle can be secured with minimal discomfort to the patient.

Still another object of the invention is to provide a floating stretcher for use in water related rescue.

These and other objects and advantages of my invention are accomplished through the use of an elongated body board. The body board is hollow and open on one end to receive a slide member therein. A base portion is connected to the slide member and is positioned relative the body board by extending the slide member selected distances from the body board. The body board is used to support a patient's upper body and upper leg portions while the base portion supports a patient's ankles and feet. The extendible slide member and base portion accommodates patients of various heights while minimizing the length of the board to only that required to accommodate the height of the patient being transported. When the present invention is stored or carried without the patient thereon, the slide member is inserted entirely within the body board with the base portion in contact therewith. This compact arrangement takes up minimal storage space and reduces the bulk of the invention for easy carrying.

Wheels are rotably connected to the base portion such that an individual may tilt the body board and base portion relative to a supporting surface and thus transport the patient, unassisted, on the supporting wheels. The wheels extend beyond the base portion opposite the slide member but do not extend below a pair of skids formed by the body board and partially defining bottom surfaces thereof. The wheels are seated in a wheel well which partially isolates the wheels from the patient's feet and ankles. By not extending below the skids, the wheels will not interfere with the sliding movement of the body board across selected supporting surfaces including the forward edges of a flight of stairs. A handle is pivotally connected to the body board opposite the base portion to assist an operator in managing the sliding movement of the board and a patient supported thereon up or down such steep inclines. The handle is telescopic and when fully extended, permits an operator to slide the body board up or down an incline while the operator maintains a substantially upright position. Fixed handles are provided at each end of the stretcher to permit two people to grip and lift the stretcher.

A pair of hip straps are connected to the body board and extend therefrom between the patient's legs and over the patient's hips to be detachably secured to opposing lateral margins of the body board. Shoulder straps are connected to the body board and extend longitudinally thereon and over the patient's shoulders to immobilize the patient's upper body. Leg and ankle straps are provided which individually secure each leg to the body board and base portion.

An inflatable U-shaped envelope is detachably and reattachably connected to the body board for immobilizing the patient's head. Straps connected to the U-shaped envelope extend over the patient's forehead and under the patient's chin to further stabilize the head and neck. Inflatable envelopes are selectively connected to the body board with hook-and-loop connector for supporting the patient's knees and lumbar during transport.

An elongated recess is defined in the upper surface of the body board for receiving an oxygen bottle. The oxygen bottle is secured within the recess by a tank strap and is isolated from the patient by a transparent dome. One or more telescopic I-V poles are pivotally connected to the board and, when extended and locked in place, will support an I-V bottle suspended therefrom.

The body board defines an internal cavity filled with a solid lightweight foam which strengthens the structural integrity of the body board and provides additional buoyancy should the stretcher be immersed in water. Additional flotation apparatus is detachably connected to the stretcher and includes a mesh detachably connected to the body board with hook-and-loop connector and a plurality of inflatable envelopes connected to the perimeter of the mesh.

BRIEF DESCRIPTION OF THE DRAWINGS

Apparatus embodying features of my invention are depicted in the accompanying drawings which form a portion of this disclosure and wherein:

FIG. 6 is a bottom view of the first embodiment of the present invention;

FIG. 10 is a perspective view of an exploded perspective view of a first embodiment of the present invention;

DESCRIPTION OF A PREFERRED EMBODIMENT

Figure 1:
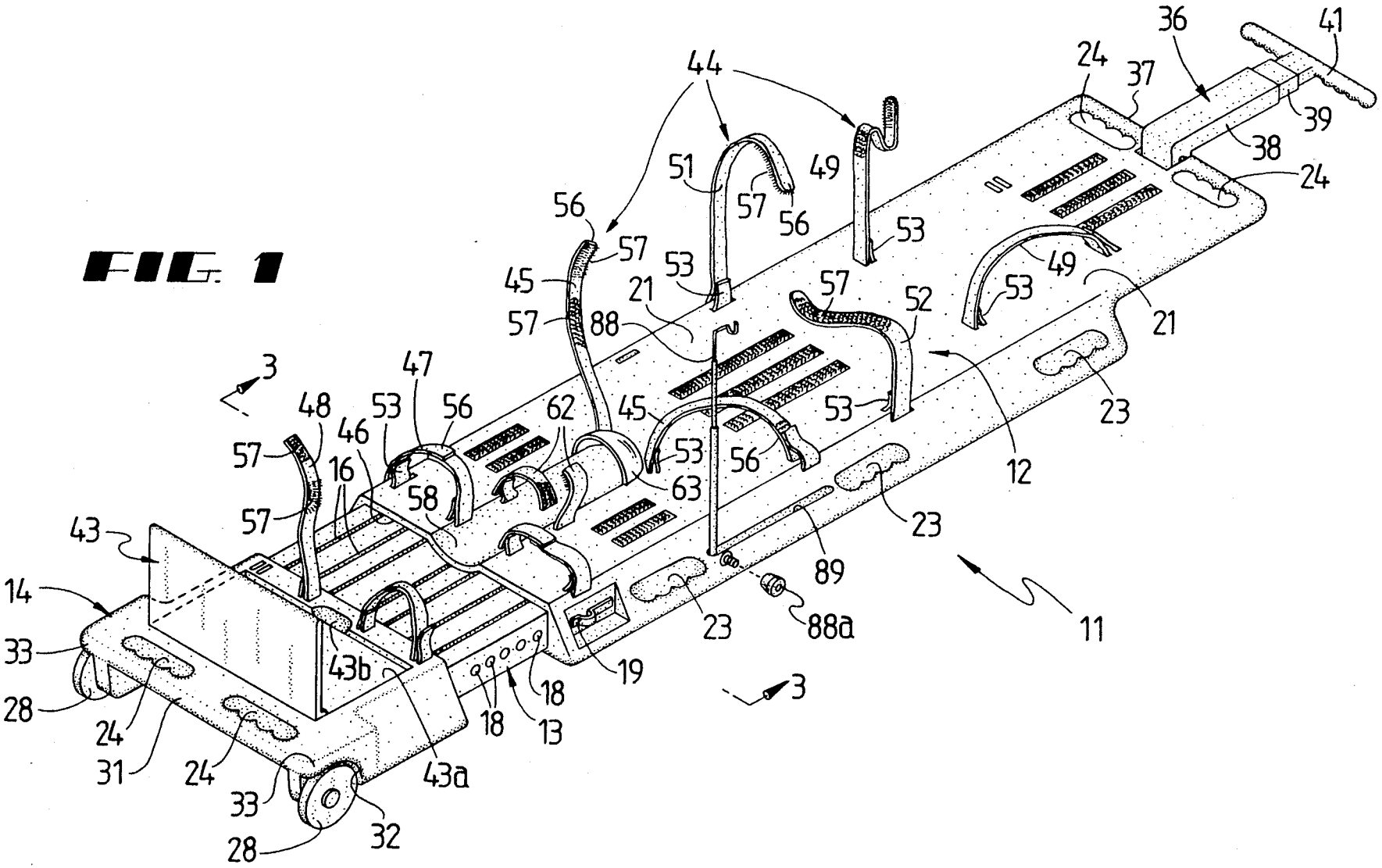
FIG. 1 is a perspective view of a first embodiment of the present invention.
Figure 2:
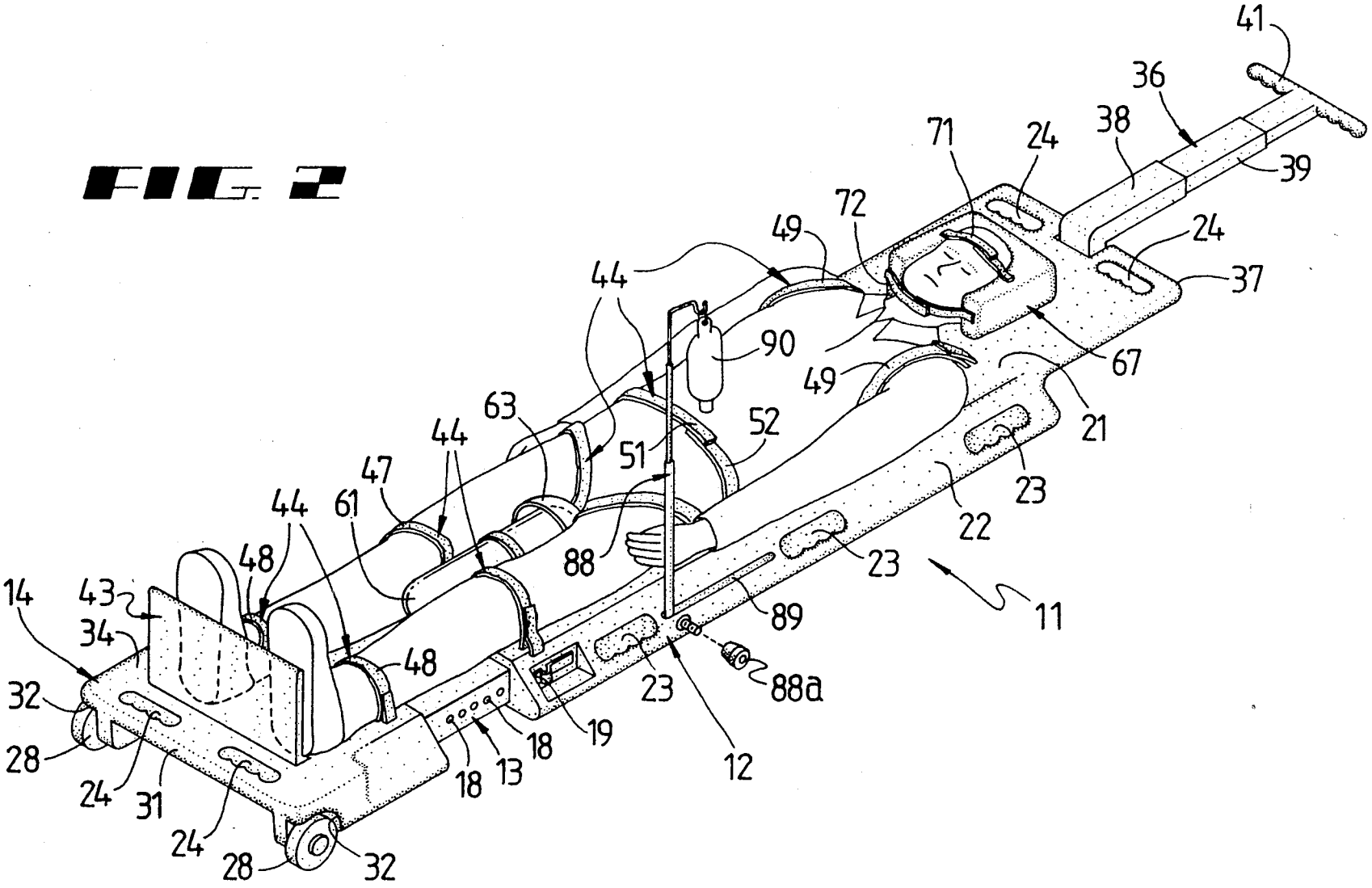
FIG. 2 is a perspective view of a first embodiment of the present invention with a patient resting thereon.
Figure 3:
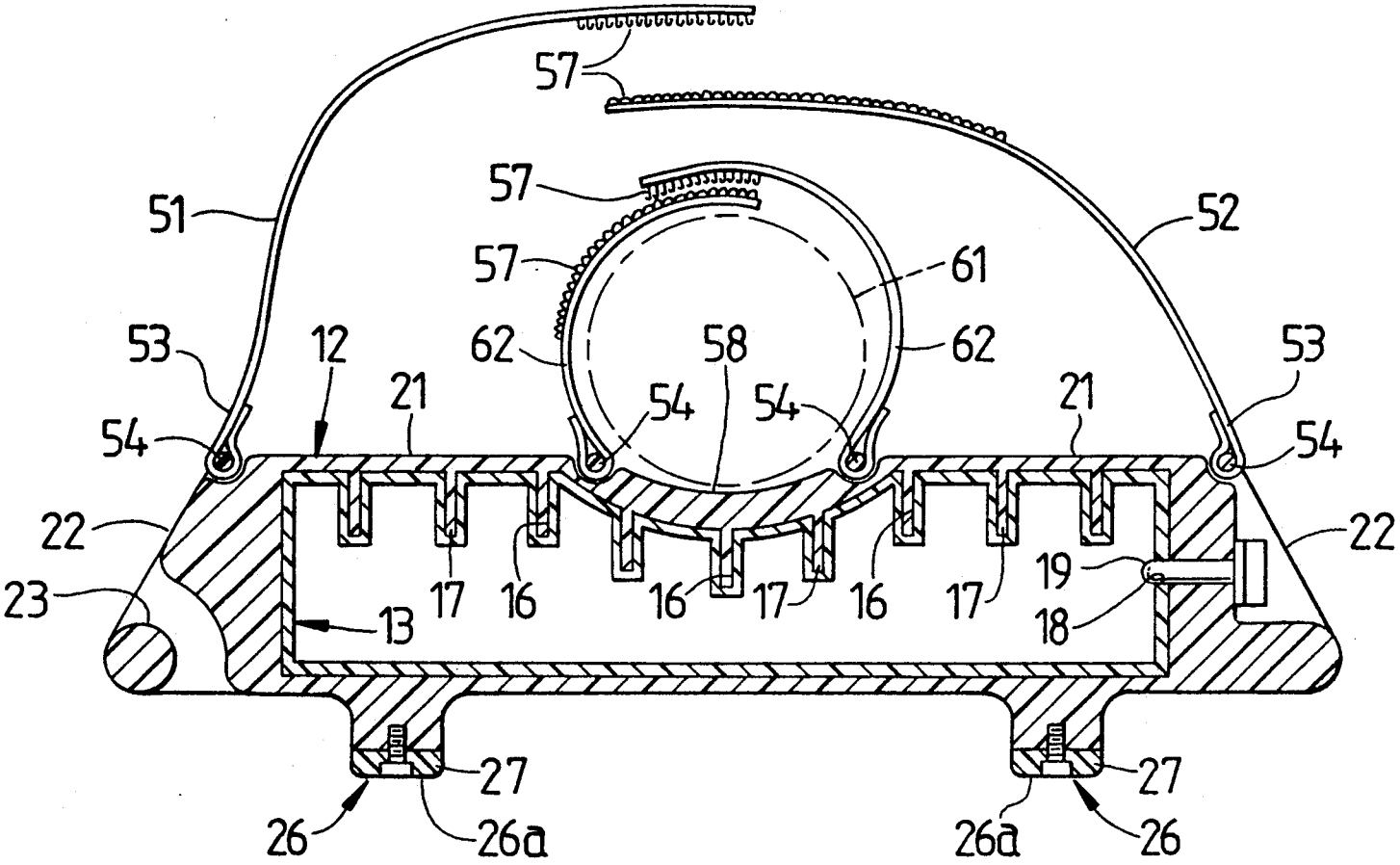
FIG. 3 is a sectional view taken along line 3—3 of FIG. 1.

Referring to the drawings for a clearer understanding of the invention, it should be noted in FIGS. 1–15 that the present invention is a stretcher 11 used primarily by emergency rescue personnel and paramedics for transporting a person from a point of injury to some location where proper treatment of the injuries can be administered. The stretcher is designed such that medically untrained personnel can use the board to remove accident victims from the point of injury to some location more easily accessible by medical personnel. As shown in FIGS. 1 and 2, a first embodiment of the stretcher 11 includes an elongated body board 12 on which a patient's upper body and upper leg portions are supported. A slide member 13 is received within the body board 12 and is extendible from an end thereof. A base portion 14 is connected to the slide member 13 opposite the body board 12 for supporting the patient's ankles and feet. As shown in FIG. 3 the slide member 13 is hollow to minimize the weight of the stretcher 11 and is corrugated, thus defining a plurality of grooves 16, to maximize the structural integrity of the slide member 13. The body board 13 has a plurality of tracks 17 partially defining the interior thereof which are received within the grooves 16 to maintain the slide member 13 in substantially parallel relation to the body board 12. The combination of body board, slide member and base portion provides a stretcher that will accommodate patients of different heights while minimizing the length of the stretcher necessary to support each patient on an individual basis. The slide member 13 may be inserted completely within the body board 12 to reduce the size of the stretcher 11 so that the stretcher can be stored within the limited space of a rescue vehicle or more easily transported by an individual. As shown in FIGS. 1–3, a plurality of lock pin holes 18 are spaced along a lateral side of the slide member 13 for receiving a spring loaded lock pin 19, as is shown in FIG. 3. The lock pin 19 extends through the body board 12 and within a selected lock pin hole 18 to secure the slide member 1 and base portion 14 to the body board 12 at a selected incremental extension therefrom. One skilled in the art will recognize that a variety of lock mechanisms can be used to secure the slide member 13 to the body board 12.

As shown in FIG. 3, the body board 12 has a trapezoidal transverse cross-section and, as is further shown in FIGS. 1–5, tapers downwardly and outwardly from an upper surface 21 to form opposing lateral extension portions 22. The lateral extension portion 22 have a plurality of handles 23 formed thereon below and outwardly from the upper surface 21. This location of the handles 23 from the upper surface 21 accommodates transportation of unusually large patients whose bodies extend laterally beyond and below the upper surface 21. The handles 23 are formed as an integral part of the lateral extension portions 22 to minimize weight and to eliminate unnecessary moving parts which might inadvertently pinch the patient during transport. Handles 24 are formed by the stretcher 11 at opposing ends thereof to facilitate the transport of the stretcher 11 by two persons, each engaging a selected end. The handles 24 are similar to handles 23 except that handles 24 are flush with the upper surface 21. As the handles 24 are located away from a supported patient's body, it is not necessary to offset handles 24 from the upper surface 21.

Figure 7:
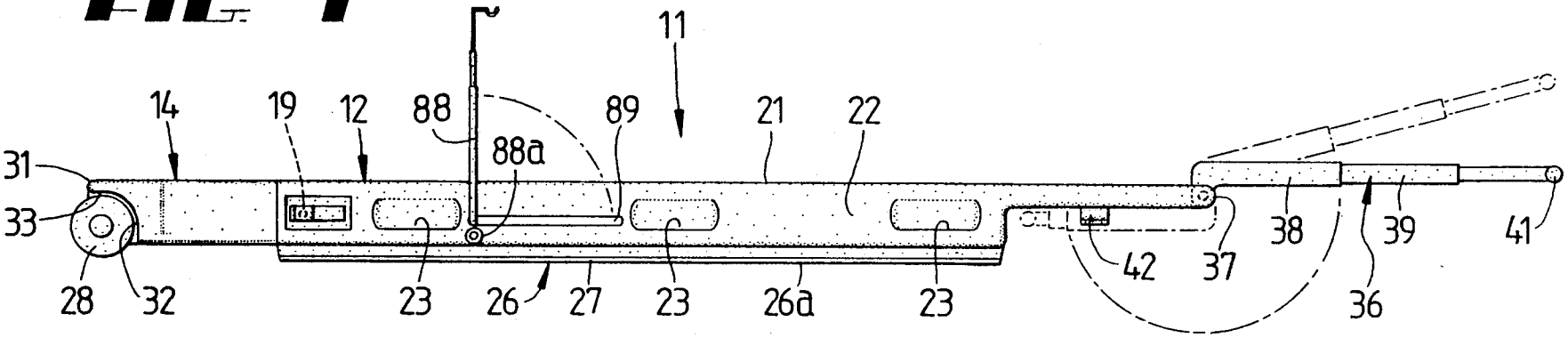
FIG. 7 is a side elevational view of the first embodiment of the present invention.
Figure 8:
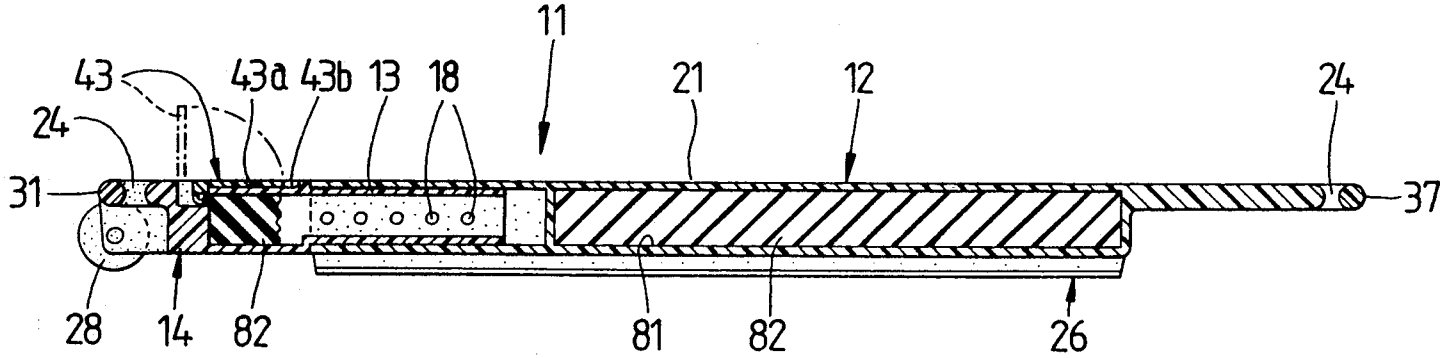
FIG. 8 is a sectional view taken along line 8—8 of FIG. 4.
Figure 9:
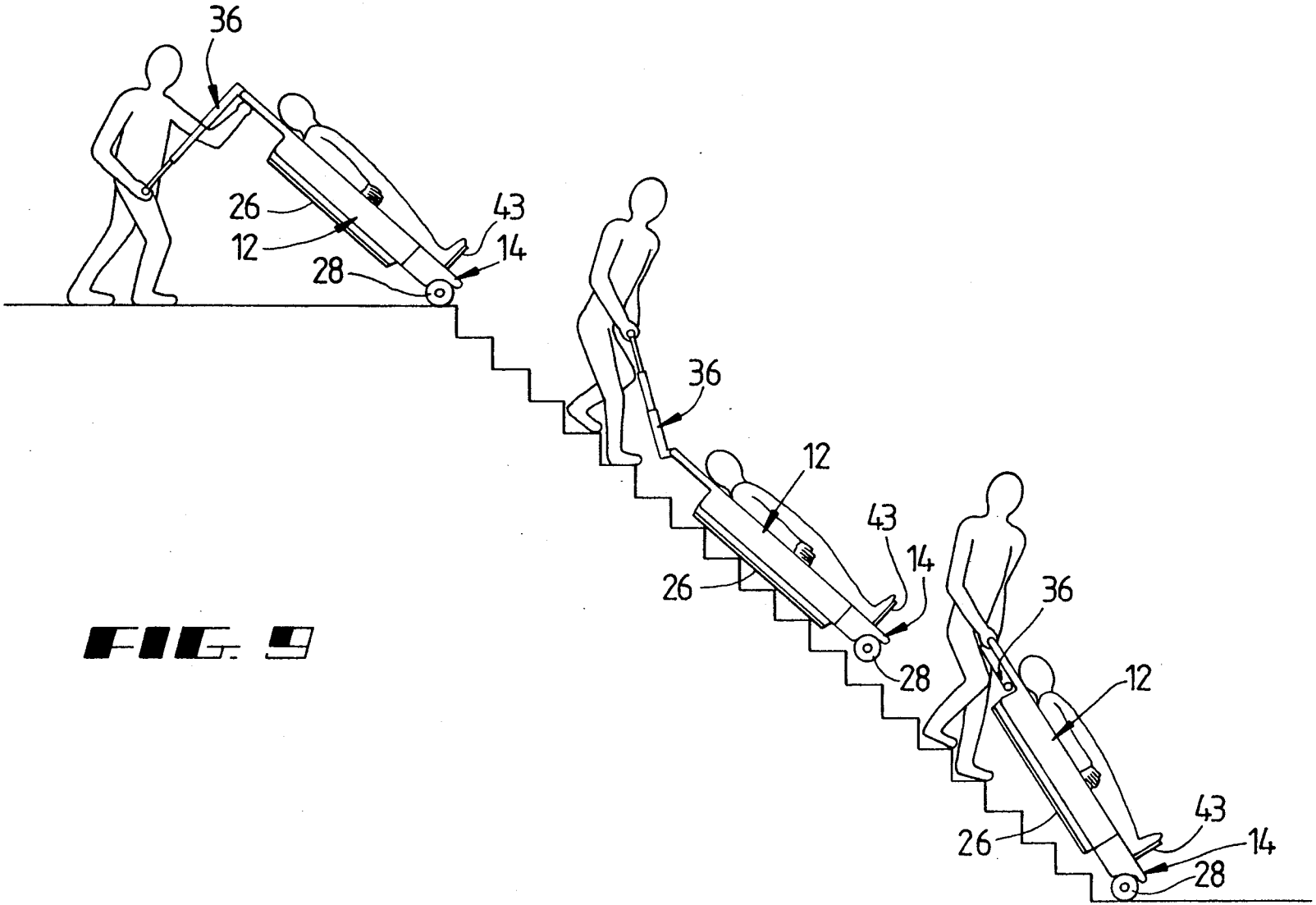
FIG. 9 is a diagrammatic view depicting the transportation of a patient supported on the present invention down a flight of stairs.

As is shown in FIGS. 3 and 5–9, a plurality of protective skids 26 are formed by the body board 12. As is shown in FIG. 9, the skids 26 protect the stretcher 11 when the stretcher is slidingly moved across a selected supporting surface. Each skid 26 defines a bottom surface **26*a* which rests on a selected supporting surface to support the body board 12 a predetermined distance above the selected supporting surface such that emergency personnel may reach intermediate the handles 23 and supporting surface to lift and carry the stretcher 11 and patient supported thereon. Skid panels 27 constructed of Teflon ® or other wear resistant materials may be detachably connected to the protective skids 26** to reduce abrasion thereof.

As shown in FIGS. 1, 2 and 4–9, a plurality of wheels 28 are rotatably connected to the base portion 14 such that the stretcher 11 may be tilted about a transverse axis relative to a selected supporting surface for rolling movement thereon. As shown in FIGS. 7–9, the wheels 28 are connected to the base portion 14 above the bottom surfaces **26*a* such that the stretcher 11 may slide across a selected supporting surface, as shown in FIG. 2, without the wheels 28 contacting said selected supporting surface. The utility of this configuration is apparent from FIG. 2 which shows a patient, supported on stretcher 11, being rolled on wheels 28 to the edge of a flight of stairs, slid down the stairs on the protective skids 26 and again rolled on wheels 28 at the bottom of the stairs. By having the wheels 28 connected to the base portion 14 above the bottom surfaces 26*a*, the stretcher slides smoothly down the stairs without the wheels 28 iteratively contacting each step and jarring the stretcher 11 and patient supported thereon. The periphery of the wheels 28 extend beyond a first end 31 of the stretcher 11 and below the base portion 14 such that the wheels 28 contact a subjacent supporting surface when the stretcher 11 is tilted a minimal angular distance relative thereto. As shown in FIGS. 1, 2 and 4–9, the base portion defines a pair of wheel wells 32 on opposing sides thereof in which the wheels 28 are rotably mounted. The wheel wells 32 are partially defined by an end portion 33 of the base portion 14 adjacent an upper surface 34 of the base portion 14. The end portion 33 isolates the wheels 28 from the patient's feet and ankles which, as shown in FIG. 2, are supported on the upper surface 34**.

Figure 4:
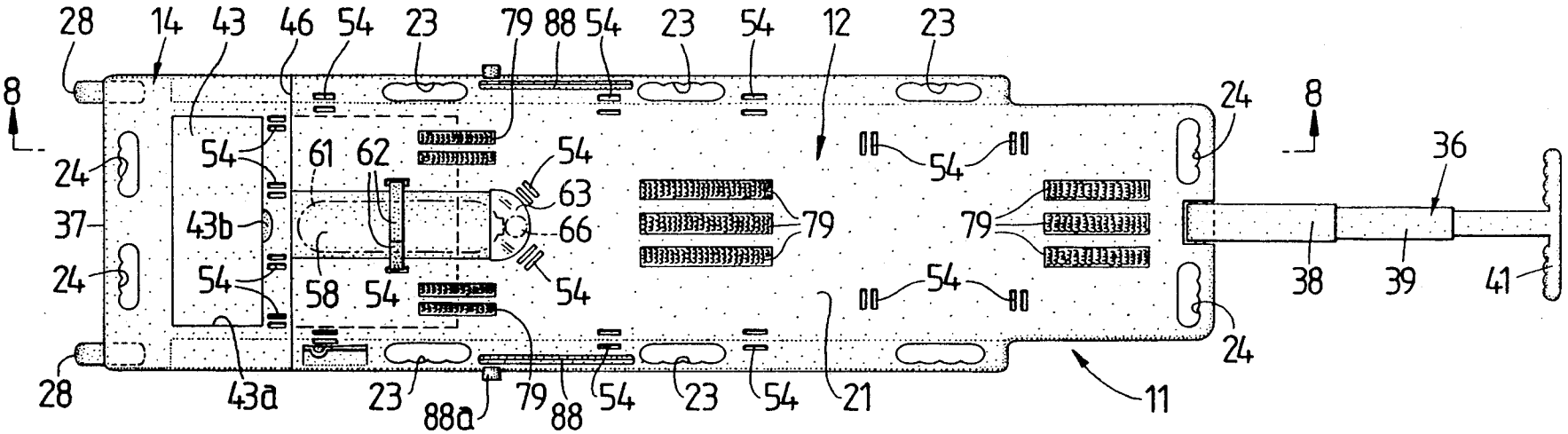
FIG. 4 is a plan view of the first embodiment of the present invention.
Figure 5:
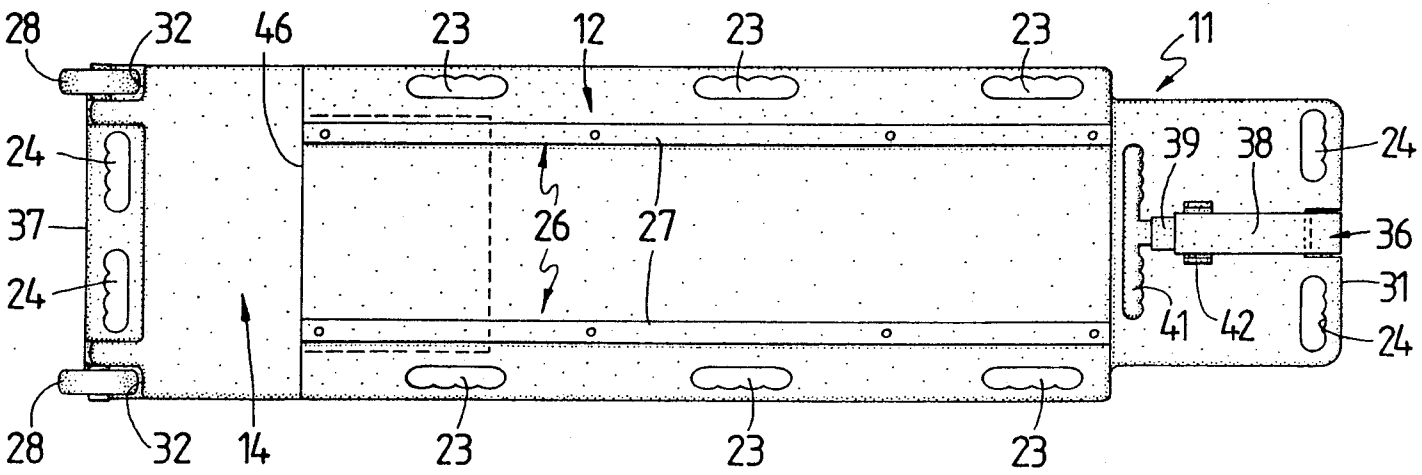
FIG. 5 is a perspective view of the first embodiment of the present invention in an inverted position.
Figure 5:
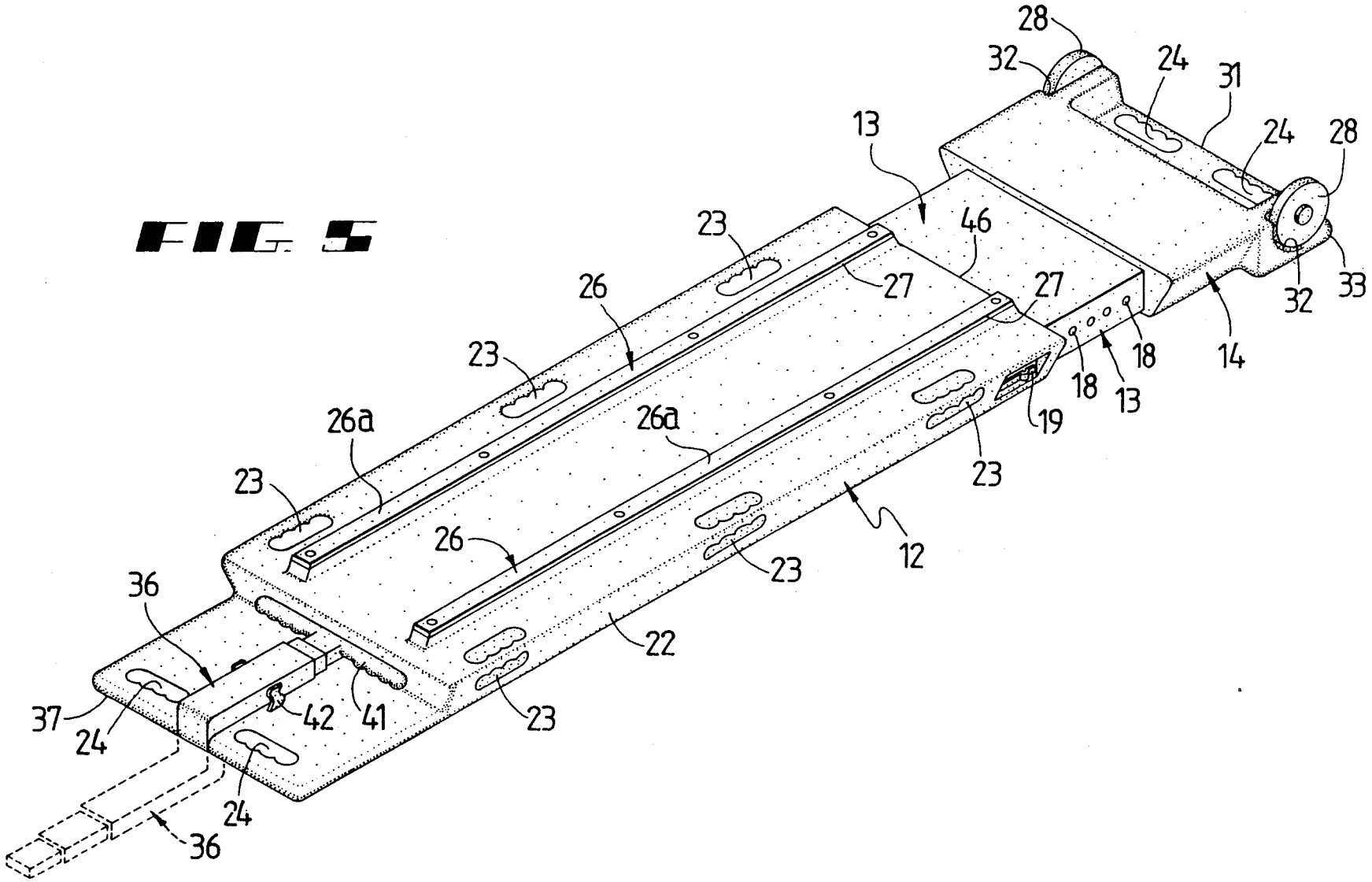

An elongated handle assembly 36 is connected to a second end 37 of the stretcher 11 opposite the wheels 28 for assisting emergency personnel in sliding the stretcher 11 and patient down a steep incline such as that shown in FIG. 9. The handle assembly 36 includes an elongated member 38 pivotally connected to the body board 12 for pivotal movement about one end thereof. A telescopic member 39 is received within the elongated member 38 and is selectively extended therefrom as shown in FIGS. 4–7 and 9. A handle 41 is connected to the telescopic member 39 in perpendicular relation thereto. As shown in FIGS. 5 and 6, the handle assembly 36 can be pivoted beneath the body board 12 and secured thereunder by clamp 42. When so secured, the handle assembly 36 is supported above the bottom surfaces **26*a* to promote unobstructed sliding movement of the stretcher 11 on the skids 26 when the handle assembly 36** is not in use.

A folding foot rest 43 is movably connected to the base portion 14 for pivotal movement from substantially planar contact with the upper surface 34 to a perpendicular extension therefrom. The foot rest 43 supports the patient when the stretcher 11 is tilted about a transversely extending axis and supported by wheels 28 as previously described. The foot rest 43, when pivoted in planar contact with the base portion 14, is received within a recess **43*a* defined in said base portion 14 and accommodates a streamline profile that promotes the efficient storage and transportation of the stretcher 11. An access notch 43 is defined in base portion 14 to provide access to the foot rest 43 for easy removal thereof from recess 43*a***.

As shown in FIGS. 1–2, a plurality of straps 44 secure the patient to the stretcher 11. The plurality of straps 44 include a pair of hip straps 45 connected to the body board along the longitudinal axis thereof. The hip straps 45 extend away from the base portion 14 and diverge from the longitudinal axis to detachably and reattachably connect to the body board 12 near the opposing lateral edges of the upper surface 21. The hip straps 45 extend between a patient's legs and over a patient's hips to secure a patient's pelvic region to the body board 12 a predetermined distance from the lower edge 46. When the body board 12 is tilted and thus supported on wheels 28, the patient is partially supported by the hip straps 45 which accordingly lessens the amount of weight supported by the patient's feet and ankles. When moving a person with leg injuries, the hip straps value becomes more apparent. The base portion 14 and foot rest 43 are positioned such that the patient is supported in a tilted position exclusively by the hip straps 45, thus eliminating any unnecessary exertion of force on the patient's injured leg. Additional leg straps 47, connected at one end to the body board 12, extend over the patient's leg and detachably and reattachably connect to the body board 12 to secure the patient's legs thereto. Ankle straps 48 are connected to the base portion 14 for securing the patient's ankles thereto. A pair of shoulder straps 49 are connected to and spaced laterally on the body board and extend over the patient's shoulders to secure the patient's upper body to the body board without obstructing the patient's chest on abdominal regions. By avoiding the chest and abdominal regions, the shoulder straps will not interfere with artificial resuscitation techniques commonly utilized by emergency and hospital personnel. Optional first and second securing straps 51 and 52 are connected to the body board 12 proximal opposing lateral margins of the upper surface 21 and extend over the patient's lower abdomen to secure the lower abdomen to the body board 12. The first and second securing straps 51 and 52 are utilized when transporting back injury patients to completely immobilize the patient's lower back. Each strap 44 is connected at a first end 53 to a strap retainer 54 which is formed in the body board 12 or base portion 14. A detailed view showing the connection of a leg strap 47 to the body board 12 is provided by FIG. 3. The hip, leg, ankle and shoulder straps 45, 47, 48 and 49 are each detachably and reattachably connected to the body board 12 at a second end 56 by a hook-and-loop connector 57 attached thereto. The second end 56 is inserted beneath and around a selected strap retainer 54 and attached to the corresponding strap via the hook-and-loop connector 57. The first and second securing straps 51 and 52 are detachably and reattachably connected to the other with hook-and-loop connector 57 connected thereto. The straps 44 and strap retainers 54 are color coded to facilitate the expedient and correct connection of the plurality of straps 44 with their corresponding strap retainer 54.

A recess 58 is defined in the upper surface 21 and extends from a lower edge 46 thereof along the longitudinal axis of the upper surface 21. Leg portions 59 are formed by the upper surface 21 on either side of recess 58 and support the patients upper leg portions. As shown in FIG. 4, the recess receives an oxygen bottle 61 which is secured therein by tank straps 62. A transparent dome shaped cover 63 is connected to the body board 12 and extends over the recess 58. The cover 63 receives an upper end of the oxygen bottle 61 thereunder and thus isolates the oxygen tank 61 from the patient's pelvic region during transport. The transparency of the cover 63 permits visual inspection of gauges 66 commonly connected to the upper end 64 of the oxygen bottle 61 such that proper oxygen flow can be maintained while the patient is supported on the stretcher 11.

As shown in FIGS. 2 and 10, an inflatable U-shaped cushion 67 is detachably and reattachably connected to the body board 12 by hook-and-loop connector 68 connected to the U-shaped cushion 67 and body board 12. The U-shaped cushion 67 is placed around the patient's head in contact with the top and sides thereof and inflated by an inflator mechanism 69 to press against the patient's head and thus limit the movement thereof. A forehead strap 71 is connected to the U-shaped cushion 67 and extends over the patient's forehead to secure the patient's head against the body board 12. A chin strap 72 is connected to U-shaped cushion 67 and extends across and engages the patient's chin to likewise secure the patient's head against the U-shaped cushion 67. An inflatable lumbar support 73 is detachably and reattachably connected to the body board 12 with hook-and-loop connector 74 to provide cushioned support of the patient's lumbar or lower back. A pair of inflatable knee supports 76 are detachably and reattachably connected to the leg portions 59 with hook-and-loop 77 for supporting the patient's knees. The lumbar support 73 and knee support 76 have inflation mechanisms 78 connected thereto and in communication therewith for facilitating the inflation thereof. As shown in FIG. 10, the portions 79 of hook-and-loop connectors 68, 74 and 77 connected to the body board 12 are significantly larger than the U-shaped cushion, lumbar support and knee supports connected thereto, respectively. The enlarged connector portions 79 allows the selected U-shaped cushion, lumbar support and/or knee support to be connected at various positions on the body board 12 to accommodate patients having different anatomical dimensions.

As shown in FIG. 8, the body board 12 defines an internal cavity 81 filled with a buoyant solid foam 82. The foam 82 promotes the buoyancy of the stretcher 11 and strengthens the structural integrity thereof. The stretcher 11 will float when immersed in water and may be further supported in water by a flotation assembly 83 shown in FIG. 10. The flotation assembly 83 includes a sheet of mesh 84 detachably and reattachably connected to the body board 12 with hook-and-loop connector 85. A plurality of inflatable envelopes 86 are connected to selected edges of the sheet of mesh 84 along selected lateral margins of the stretcher 11 such that the stretcher 11, when placed in water, is seated intermediate the envelopes 86 and supported thereby and by the sheet of mesh 84 connected thereto. When not in use, the flotation assembly 83 is deflated, disconnected from the board and stored in a relatively compact container 87 for easy transport.

A telescopic I-V pole 88 is pivotally connected to body board 12 and seated within a recess 89 formed therein. The I-V pole can be selectively pivoted to a selected angular position relative to the body board 12 and secured in such position by securing nut 88*a*. The I-V pole 88 may be extended as shown in FIG. 2 and locked in such extended position to support an I-V bottle 90.

Figure 11:
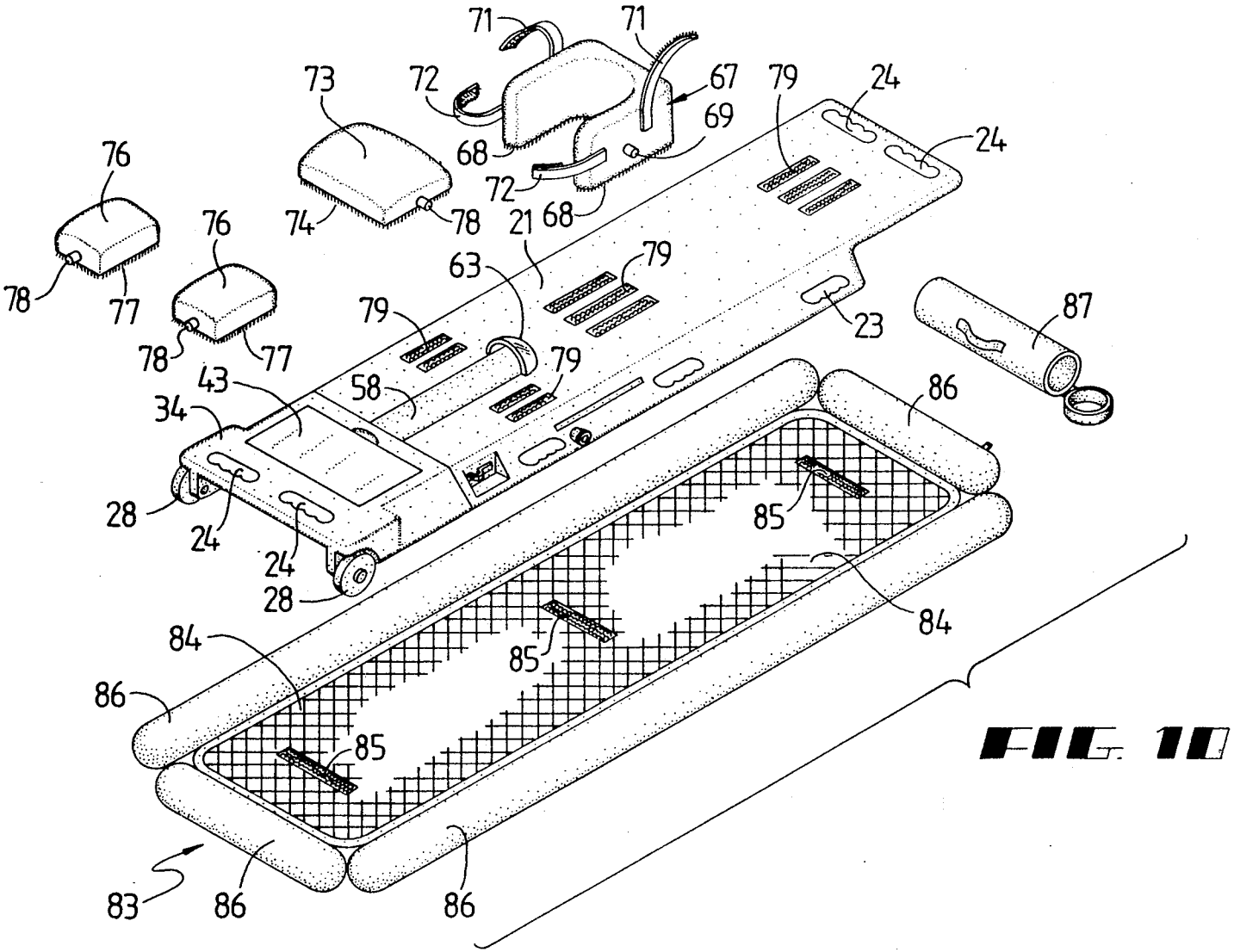
FIG. 11 is a detailed side elevational view of a second embodiment of the present invention with wheels supported in an extended position.
Figure 11:
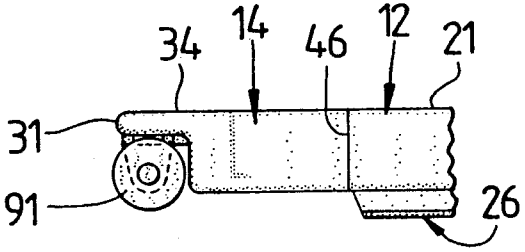
Figure 12:
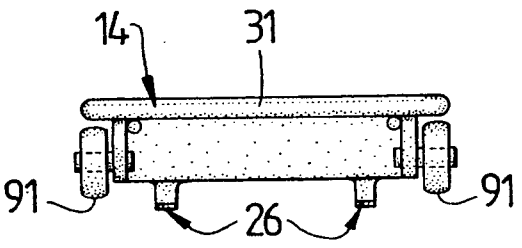
FIG. 12 is a detailed end view of a second embodiment of the present invention with wheels supported in an extended position.
Figure 13:
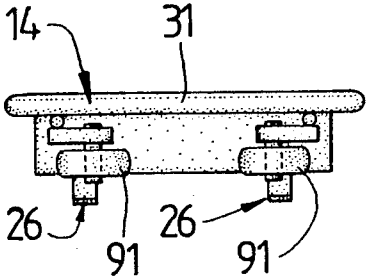
FIG. 13 is a detailed side elevational view of the second embodiment of the present invention with wheels supported in a retracted position.

A second embodiment of the present invention is shown in FIGS. 11-13, and includes the subject matter described in the first embodiment exclusive of the wheels 28 and their corresponding wheel wells 32. The second embodiment includes a pair of wheels 91 movably connected to the base portion 14 for pivotal movement from an extended position shown in FIGS. 11-12 to a retracted position shown in FIG. 13. In the retracted position, the wheels 91 are supported above the skids 26 and thus accommodate the unobstructed sliding movement thereof. When pivoted to the extended position, the wheels are supported above the skids 26 but extend below the base portion 14 a distance sufficient to facilitate the rolling movement of the stretcher 11 when tilted relative to a selected supporting surface.

Figure 14:
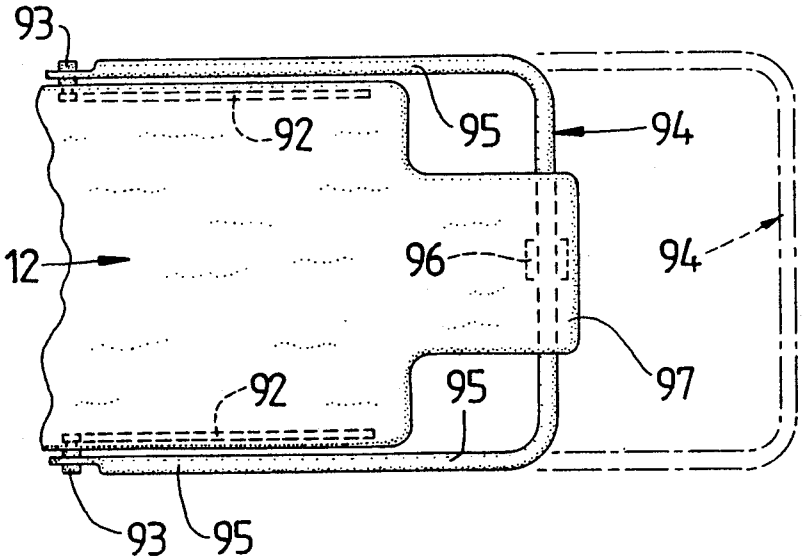
FIG. 14 a detailed plan view of a third embodiment of the present invention with a handle supported in a storage position.
Figure 15:
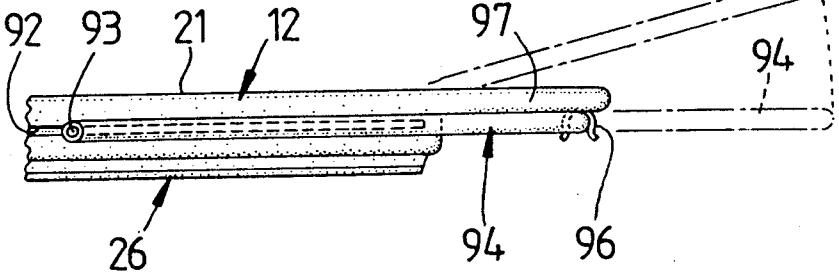
FIG. 15 is a detailed side elevational view of a third embodiment of the present invention with a handle supported in a pivotal position.

A third embodiment of the present invention is shown in FIGS. 14-15, and includes the subject matter described in the first embodiment exclusive of the elongated handle assembly 36 previously described. The second embodiment includes a handle assembly 36 having a pair of guide tracks 92 formed by and defining opposing lateral margins of said body board 12, a track mount 93 slidingly mounted within each guide track 92 and a substantially U-shaped handle 94 having two leg portions 95, each connected to one of the track mounts 93 such that the handle 94 will slide to the second end 37 of the stretcher 11 and pivot relative thereto. The handle 94 may thus be moved from a stored position shown in FIG. 14 to a pivotal position shown in FIG. 15. When in the stored position, the handle 94 extends in substantially coplanar relation to the body board 12 and is secured in such position by a spring loaded clamp 96 integrally connected subjacently to a neck portion 97 of said body board 12. The handle 94 when engaged by clamp 96 extends laterally from the neck portion 97 to form a stationary handle by which the second end of the stretcher 11 can be lifted. From the foregoing, it should be clear that the present apparatus represents a substantial improvement over the prior art.

While I have shown my invention in three forms, it will be obvious to those skilled in the art that it is not so limited but is susceptible of various changes and modifications without departing from the spirit thereof.

What I claim is:

1. A stretcher operated by one or more persons for transporting an injured patient, comprising:

(a) an elongated body board including an upper surface on which said patient's upper body and upper leg portions are supported and a plurality of handles formed along each of a pair of opposing lateral margins thereof by a pair of extension portions extending laterally and downwardly from said upper surface on opposite side thereof to form said handles below and laterally of said upper surface;

(b) extension means longitudinally and slidably received within the body board for supporting said patient's lower leg portion, ankles and feet such that said extension means can be extended selected distances from said body board to accommodate patients of different height; and (c) vertical support means connected to said extension means in perpendicular extension therefrom for supporting a patient resting on said body board and said extension means when said body board and said extension means are tilted upwardly about one end of said extension.

2. A stretcher as described in claim 1 further comprising a plurality of protective skids formed by said body board and defining bottom surfaces thereof with said protective skids spaced inwardly from said pair of extension portions to support said handles a predetermined distance above a subjacent supporting surface.

3. A stretcher operated by one or more persons for transporting an injured patient, comprising:

(a) an elongated body board on which said patient's upper body and upper leg portions are supported; and (b) extension means including a slide member slidingly received within said body board for longitudinal movement therein and a base portion connected to said slide member for supporting said patient's ankles and feet such that said extension means can be extended selected distances from said body board to accommodate patient's of different height; and (c) vertical support means connected to said extension means in perpendicular extension therefrom for supporting a patient resting on said body board and said extension means when said body board and said extension means are tilted upwardly about one end of said extension means.

4. A stretcher as described in claim 3 further comprising lock means connected to said body board for selectively securing said slide member thereto at selected incremental extensions therefrom.

5. A stretcher as described in claim 3 comprising a plurality of ankle straps connected to said base portion for securing said patient's ankles thereto.

6. A stretcher as described in claim 3 further comprising a plurality of wheels connected to said base portion for supporting said base portion and said body board when said body board and base portion are tilted relative a subjacent supporting surface such that one person may transport said patient on said supporting plurality of wheels, wherein said plurality of wheels are spaced from said subjacent supporting surface when said body board is slid thereacross.

7. A stretcher as described in claim 6 wherein said base portion defines a plurality of wheel wells in which said wheels are rotably mounted such that said wheel wells isolate said wheels from said patient's feet.

8. A stretcher as described in claim 3 wherein said base defines a plurality of handles by which said base can be engaged and lifted.

9. A stretcher as described in claim 3 wherein said body board comprises an internal chamber filled with a light-weight solidified foam which reinforces the structural integrity of said body board, wherein said solidified foam is buoyant and thus facilitates flotation of said body board.

10. A stretcher operated by one or more persons for transporting an injured patient, comprising:

(a) an elongated body board on which said patient's upper body and upper leg portions are supported;

(b) extension means longitudinally and slidably received within the body board for supporting said patient's lower leg portion, ankles and feet such that said extension means can be extended selected distances from said body board to accommodate patients of differing height; and (c) a pair of wheels pivotally connected to said extension means such that said wheels can be pivoted from a downwardly extended position to a retracted storage position, wherein said wheels, when pivoted to said storage position, are spaced from a subjacent supporting surface to accommodate unobstructed sliding movement of said body board and extension means thereacross.

11. A stretcher operated by one or more persons for transporting an injured patient, comprising:

(a) an elongated body board on which said patient's upper body and upper leg portions are supported, including a pair of parallel leg portions and an elongated recess on an upper surface thereof, wherein said recess extends from a lower edge of said body board and between said leg portions for receiving an oxygen bottle, and at least one tank strap connected to said leg portions and extending transversely across said recess for securing said oxygen bottle received therein; and (b) extension means longitudinally and slidably received within the body board for supporting said patient's lower leg portion, ankles and feet such that said extension means can be extended selected distances from said body board to accommodate patient's of different height.

12. A stretcher operated by one or more persons for transporting an injured patient, comprising:

(a) an elongated body board on which said patient's upper body and upper leg portions are supported, including a pair of parallel leg portions and an elongated recess on an upper surface thereof, wherein said recess extends from a lower edge of said body board and between said leg portions for receiving an oxygen bottle, and a transparent cover connected to said body board and extending over said recess, wherein an upper end of said oxygen tank extends beneath said cover and is thus isolated form said patient while remaining visible for inspection; and (b) extension means longitudinally and slidably received within the body board for supporting said patient's lower leg portion, ankles and feet such that said extension means can be extended selected distances from said body board to accommodate patient's of different height.

13. A stretcher operated by one or more persons for transporting an injured patient comprising:

(a) an elongated body board on which said patient's upper body and upper leg portions are supported including a head immobilizing means detachably and reattachably connected to said body board proximal a first end thereof by hook-and-loop connectors connected to said head immobilizing means and to said body board such that said head immobilizing means can be attached to said body board at selected locations thereon to accommodate patients having different anatomical dimensions; and (b) extension means longitudinally and slidably received within the body board for supporting said patient's lower leg portion, ankles and feet such that said extension means can be extended selected distances from said body board to accommodate patient's of different height.

14. A stretcher operated by one or more persons for transporting an injured patient, comprising:

(a) an elongated body board on which said patient's upper body and upper leg portions are supported;

(b) extension means longitudinally and slidably received within the body board for supporting said patient's lower leg portion, ankles and feet such that said extension means can be extended selected distances from said body board to accommodate patient's of different height; and (c) a plurality of inflatable envelopes detachably and reattachably connected to said body board for supporting portions of said patient's anatomy not directly contacting said body board.

15. A stretcher as described in claim 14 wherein said plurality of inflatable envelopes comprises a pair of inflatable knee supports, each detachably connected to said body board beneath said patient's knees.

16. A stretcher as described in claim 14 wherein said plurality of inflatable envelopes comprises an inflatable lumbar support detachably connected to said body board beneath the lumbar region of said patient's back.

17. A stretcher as described in claims 14 wherein said inflatable envelopes are detachably and reattachably connected to said body board by hook-and-loop connectors connected to said inflatable envelopes and to said body board such that said inflatable envelopes are attached to said body board at selected locations thereon to accommodate patients having different anatomical dimensions.

18. A stretcher operated by one or more persons for transporting an injured patient, comprising:

(a) an elongated body board on which said patient's upper body and upper leg portions are supported;

(b) extension means longitudinally and slidably received within the body board for supporting said patient's lower leg portion, ankles and feet such that said extension means can be extended selected distances from said body board to accommodate patient's of different height; and (c) flotation means detachably and reattachably connected to said body board and said extension means and including a sheet for mesh extending beneath said body board and extension means and a plurality of inflatable envelopes connected to selected edges of said sheet of mesh along selected lateral margins of said body board and extension means such that said body board and extension means when placed in water are seated intermediate said envelopes and supported thereby and by said sheet of mesh connected thereto.

19. A stretcher operated by one or more persons for transporting an injured patient, comprising:

(a) an elongated body board on which said patient's upper body and upper leg portions are supported;

(b) extension means longitudinally and slidably received within the body board for supporting said patient's lower leg portion, ankles and feet such that said extension means can be extended selected distances from said body board to accommodate patient's of different height; and (c) elongated handle means pivotally connected to said body board opposite said extension means and extending longitudinally from said body board such that it can be pivoted beneath said body board and secured thereunder, with telescoping means slidably received within said elongated member and extendible therefrom and a handle connected to said telescoping means in substantially perpendicular relation thereto.

20. A stretcher for transporting an injured person from the point of injury to a treatment facility, comprising:

(a) an elongated patient support means having a substantially planar upper surface on which said patient is supported including an elongated body board, for supporting said patient's upper body, a slide member longitudinally and slidingly received within said body board and extendible therefrom and a base portion connected to said slide member opposite said body board for supporting said patient's feet and ankles, wherein said base portion can be moved relative said body board with said slide member to accommodate patients of varying height; and (b) a plurality of wheels rotatably connected to a first end of said patient support means, such that said wheels extend radially beyond the longitudinal extension of said first end and are spaced above a subjacent supporting surface when said patient support is supported thereon in substantially parallel planar relation thereto, such that said patient support means may slide across said subjacent supporting surface with said wheels spaced therefrom, and wherein said wheels contact said supporting surface, when said patient support means is tilted relative thereto, to support said patient support means such that said patient may be transported thereon by an individual.

21. A stretcher as described in claim 20 further comprising a foot rest pivotally connected to said base portion for supporting said patient when said body board and base portion are tilted relative to said supporting surface.

22. A stretcher as described in claim 20, further comprising at least one protective skid formed by said patient support means and defining one or more bottom surfaces thereof for protecting said patient support means from wear.

23. A stretcher as described in claim 20 further comprising a plurality of hip straps, connected to said patient support means for securing a patient's pelvic region thereto and supporting said patient on said patient support means when said patient support means is tilted relative to said subjacent supporting surface, wherein said hip straps extend between a patient's legs proximal said patient's pelvis, diverge over said patient's hips and detachably and reattachably connect to said patient support means at opposing lateral margins thereof.

24. A stretcher for transporting an injured person from the point of injury to a treatment facility, comprising:

(a) an elongated patient support means having a substantially planar upper surface on which said patient is supported;

(b) a plurality of wheels rotatably connected to a first end of said patient support means, such that said wheels extend radially beyond the longitudinal extension of said first end and are spaced above a subjacent supporting surface when said patient support is supported thereon is substantially parallel planar relation thereto, such that said patient support means may slide across said subjacent supporting surface with said wheels spaced therefrom, and wherein said wheels contact said supporting surface, when said patient support means is tilted relative thereto, to support said patient support means such that said patient may be transported thereon by an individual; and (c) bottle engaging means for securing an oxygen bottle to patient support means, including a recess defined in said patient support means and in which said oxygen bottle is received and at least one tank strap connected to said patient support member for securing said oxygen bottle within said recess.

25. A stretcher for transporting an injured person from the point of injury to a treatment facility, comprising:

(a) an elongated patient support means having a substantially planar upper surface on which said patient is supported; and (b) a plurality of wheels rotatably connected to a first end of said patient support means, such that said wheels extend radially beyond the longitudinal extension of said first end and are spaced above a subjacent supporting surface when said patient support is supported thereon in substantially parallel planar relation thereto, such that said patient support means may slide across said subjacent supporting surface with said wheels spaced therefrom, and wherein said wheels contact said supporting surface, when said patient support means is tilted relative thereto, to support said patient support means such that said patient may be transported thereon by an individual;

(c) elongated handle means pivotally connected to said patient support means opposite said plurality of wheels and extending therefrom such that an individual can engage said handle means while in a standing position to control the sliding movement of said body board across an inclined supporting surface, and such that said elongated handle member can be pivoted beneath said body board and secured thereto, and includes telescoping means slidingly received within said elongated member and extendible therefrom and a handle connected to said telescoping means in substantially perpendicular relation thereto.

26. A stretcher for transporting an injured person from the point of injury to a treatment facility, comprising:

(a) an elongated patient support means having a substantially planar upper surface on which said patient is rested and at least one protective skid spaced below said upper surface for sliding movement across a subjacent supporting surface; and (b) elongated handle means pivotally connected at one end to a selected end of said patient support means for rotational movement about a transverse axis including an elongated member pivotally connected to said selected end such that said elongated member, when pivoted beneath said patient support means, is detachably secured in contact therewith above said protective skids such that said elongated member is spaced from said subjacent supporting surface, and telescoping means slidingly received within said elongated member and extendible therefrom.

27. A stretcher for transporting an injured person from the point of injury to a treatment facility, comprising:

(a) an elongated patient support means having a substantially planar upper surface on which said patient is rested and at least one protective skid spaced below said upper surface for sliding movement across a subjacent supporting surface; and (b) elongated handle means pivotally connected at one end to a selected end of said patient support means for rotational movement about a transverse axis including a pair of track mounts each slidably mounted to one of a pair of guide tracks formed on opposing lateral margins of said patient support means and a substantially U-shaped handle having two leg portions each pivotally connected to one of said pair of track mounts such that said handle is slidable to said selected end of said patient support means for pivotal movement relative thereto.

28. A stretcher as described in claim 27 wherein said clamp means comprises:

(a) a neck portion integrally connected to said patient support means and extending longitudinally therefrom; and (b) a spring loaded clamp connected to said neck portion subjacently thereto, wherein said U-shaped handle when detachably engaged by said spring loaded coamp extends laterally from said neck portion to form a stationary handle by which said selected end of said patient support means can be lifted.

29. A stretcher for transporting an injured patient's body, comprising:

(a) an elongated body board on which said patient is supported; and (b) bottle securing means connected to and partially formed by said body board for securing an oxygen bottle thereto such that said oxygen bottle can be used to supply oxygen to said patient during transport including an elongated recess formed in an upper surface of said body board and in which said oxygen bottle is partially received and at least one tank strap connected to said body board proximal said recess and extending over said oxygen bottle for detachably securing said oxygen bottle within said recess.

30. A stretcher as described in claim 29 wherein said bottle securing means further comprises a transparent cover connected to said upper surface and coextending said recess at a selected end thereof, wherein said transparent cover extends over said recess and receives a portion of said oxygen bottle thereunder to isolate said patient from said portion of said oxygen bottle while permitting visual inspection thereof.

31. A stretcher as described in claim 29 further comprising a telescopic I-V pole pivotally connected to said patient support means and having means thereon for locking said I-V pole in a selected angular position relative to said patient support means.

* * * * *